US006305861B1

(12) United States Patent
Gueret

(10) Patent No.: US 6,305,861 B1
(45) Date of Patent: Oct. 23, 2001

(54) PACKAGING AND APPLICATOR DEVICE, AND A REFILL ELEMENT FOR SUCH A DEVICE

(75) Inventor: Jean-Louis Gueret, Paris (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 08/805,934

(22) Filed: Feb. 25, 1997

(30) Foreign Application Priority Data

Feb. 28, 1996 (FR) ..... 96 02477

(51) Int. Cl.[7] ..... A46B 11/00
(52) U.S. Cl. ..... 401/122; 401/262; 401/121
(58) Field of Search ..... 401/122, 262, 401/129, 130, 121; 15/220, 4

(56) References Cited

U.S. PATENT DOCUMENTS

| | | | | |
|---|---|---|---|---|
| 3,010,140 | * | 11/1961 | Thomas | 401/262 |
| 3,072,953 | * | 1/1963 | Bunke | 401/262 X |
| 3,132,653 | * | 5/1964 | Gazdik | 401/129 X |
| 3,150,220 | * | 9/1964 | Howell | 401/262 |
| 4,282,891 | * | 8/1981 | Daceppe | 401/122 X |
| 4,380,841 | * | 4/1983 | Thomas | 15/220.4 |
| 4,440,181 | * | 4/1984 | Scherer | 401/122 X |
| 5,054,946 | * | 10/1991 | Morel | 401/122 |

FOREIGN PATENT DOCUMENTS

| | | | | |
|---|---|---|---|---|
| 338327 | * | 6/1959 | (CH) | 15/220.4 |
| 86 09 637 U | | 6/1986 | (DE) . | |
| 0 405 103 | | 1/1991 | (EP) . | |
| 2 567 006 | | 1/1986 | (FR) . | |
| 452640 | | 2/1936 | (GB) . | |
| 2243762 | * | 11/1991 | (GB) | 15/220.4 |

* cited by examiner

*Primary Examiner*—David J. Walczak
(74) *Attorney, Agent, or Firm*—Oliff & Berridge, PLC

(57) ABSTRACT

A device for packaging and applying a substance that is in liquid, semiliquid, or powder form, in particular a cosmetic, includes a receptacle that is open at one end and suitable for containing the substance, and an applicator with a stalk provided at one end with an applicator element and at its other end with a handle member. The applicator element is inserted into the receptacle and is withdrawn therefrom in contact with an elastically deformable wiper member. The wiper member is constituted at least in part by foam with at least 5% of open cells.

37 Claims, 8 Drawing Sheets

PACKAGING AND APPLICATOR DEVICE, AND A REFILL ELEMENT FOR SUCH A DEVICE

FIELD OF THE INVENTION

The present invention relates to the field of packaging and applicator devices for a substance that may be in liquid, semiliquid, or powder form, in particular for a cosmetic.

More particularly, the invention relates to a device of the type comprising a receptacle open at one end and suitable for containing said substance, and an applicator including a stalk provided at one end with an applicator element and at the other end with a handle member, the applicator element being inserted into the receptacle and being withdrawn therefrom in contact with an elastically deformable wiper member housed in the receptacle.

BACKGROUND OF THE INVENTION

French patent application No. 2 285 101 discloses a packaging and applicator device of that type, containing eye shadow in powder form. In that known device, the wiper member is constituted, for example, by cork or by rubber foam.

Makeup can only be applied properly providing the applicator element is wiped in satisfactory manner.

If the applicator element is wiped excessively, then the user needs to reload it frequently with makeup.

In contrast, incomplete wiping leaves excess makeup on the applicator element, thereby making it difficult to apply, and causing makeup to be wasted. In particular, the makeup can dry on the stalk and form a solid residue that is liable to flake off and produce solid fragments that spoil the quality of the makeup.

On going past known wiper members, the applicator element also behaves like a piston an causes a disagreeable popping noise to be given off.

When the makeup is a powder, the puff of air associated with the popping noise can blow the powder about, and naturally that is not desirable.

OBJECTS AND SUMMARY OF THE INVENTION

An object of the present invention is to provide an improved packaging and applicator device.

In the device, said wiper member is constituted at least in part by foam comprising at least 5% of open cells.

The use of such a foam presents numerous advantages. When the makeup is a liquid or a semiliquid, the foam can absorb the makeup and moisten the stalk of the applicator, thus preventing the formation of a solid deposit that is liable to flake and generate solid fragments that can spoil the quality of the makeup.

Because the foam is porous, air can also pass through it while the applicator is being installed or withdrawn.

This prevents pressure inside the receptacle rising or falling and thus prevents a popping noise being given off. When the makeup is a powder, this prevents the powder being blown about.

In a particular embodiment of the invention, the foam is in contact with the stalk of the applicator when the applicator is in place in the receptacle.

Advantageously, care is taken to ensure that the foam is not compressed excessively by the stalk of the applicator when the applicator is housed in the receptacle, in order to avoid any danger of permanently deforming the foam which could spoil wiping quality.

For this purpose, in a first variant of the invention, it is possible to provide a hole passing through the foam axially and of a diameter that is equal to or slightly less than the diameter of the stalk. In a second variant, it is possible to make a slot passing through the foam axially and to use a stalk that is extremely fine, preferably made of metal, and having a diameter lying in the range 0.2 mm to 0.5 mm, for example.

In a particular embodiment of the invention, the foam of the wiper member is disposed in such a manner as to be situated in contact with the portion of the stalk that is adjacent to the handle member when the applicator is in place on the receptacle. This prevents there being a volume of air present above the wiper member when the applicator is in place and the consequent formation of solid residue by drying.

In a particular embodiment of the invention, the foam is permanently in contact with the substance contained in the receptacle.

In a particular embodiment of the invention, the foam is impregnated with all of the substance contained in the receptacle. In which case, it is preferable for the foam to occupy substantially all of the inside of the receptacle.

In a particular embodiment of the invention, the wiper member comprises a block of foam that is stiffened at its periphery and over at least a portion of its height by being stuck to the wall of the receptacle, in particular to prevent it being compressed when the applicator is inserted into the receptacle.

In a particular embodiment of the invention, the receptacle is elongate in shape and the applicator stalk is rectilinear. The width of the opening of the receptacle mouth is selected to avoid the edges of the receptacle being dirtied when the applicator moves past them, and preferably the width of the opening of the mouth of the receptacle is selected so as to allow the stalk to be tilted inside the receptacle by at least 10° relative to the longitudinal axis of the receptacle.

In a particular embodiment of the invention, the applicator stalk has a middle portion and a portion adjacent to the applicator element, with the outside diameter of said portion adjacent to the applicator element being greater than that of said middle portion.

In a particular embodiment of the invention, the device further includes a wiper lip.

The wiper lip is preferably situated at the outside of the mouth of the receptacle and it is extended outwards by a wall that flares going away from the foam.

In a particular embodiment of the invention, the foam has a tapering hole.

The invention also provides a refill element for a packaging and applicator device of the above kind. The invention also provides a receptacle fitted with the wiper member, as defined above, and provided with a closure capsule to form a refill element.

BRIEF DESCRIPTION OF THE DRAWINGS

Other characteristics and advantages of the present invention appear on reading the following detailed description of non-limiting examples of the invention, and on inspecting the accompanying drawings, in which.

MORE DETAILED DESCRIPTION

Figure 1:
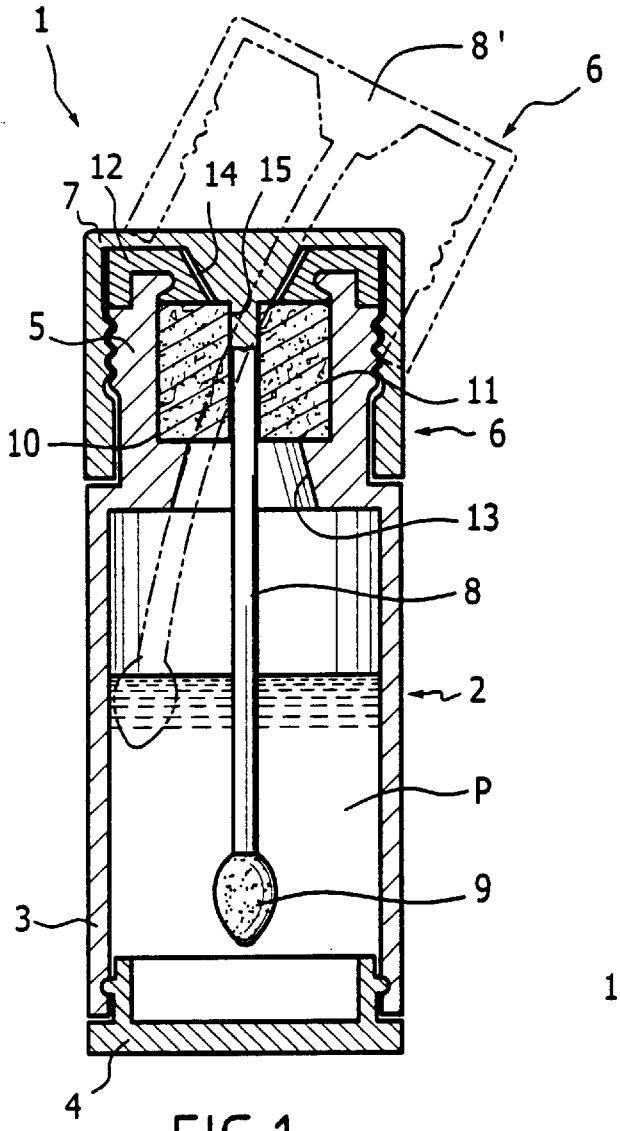
FIG. 1 is a diagrammatic axial section through a device constituting a first embodiment of the invention.

FIG. 1 shows a first embodiment of a device 1 of the invention.

The device 1 comprises a receptacle 2 and an applicator 6.

The receptacle 2 is constituted by an injection molded tubular body 3 and a bottom 4 that is snapfastened to the body 3. The top end of the body 3 has a neck 5 with an outside thread.

In the example described, the receptacle 2 contains a liquid cosmetic P using water as its solvent, e.g. an aqueous formulation of polyurethane or acrylic resin. By way of example, it may be liquid lipstick.

The applicator 6 has a handle member 7 that also serves as a cap for closing the receptacle 2, suitable for being screwed onto the neck 5 and extended downwards by a stalk 8 that can be rigid or flexible, and that is provided at its end with an applicator element 9 that can be of any conventional type, and which is merely represented very diagrammatically in FIG. 1. In the example described, the applicator element has an outside diameter greater than that of the stalk.

By way of example, the stalk 8 has a diameter lying in the range 0.2 mm to 0.5 mm.

The cross-section of the applicator element 9 may be circular or otherwise, and its side surface may include relief, e.g. it may be constituted by a non-absorbent applicator such as a brush, by foam that is optionally flocked, by felt, by a paint brush, by flocked plastic, or by an elastomer endpiece.

The applicator element may also be constituted by a hollow body capable of receiving a supply of cosmetic.

The neck 5 has an inside shoulder to form a housing 10 for receiving from above a block of foam 11 that serves as a wiper member.

The block of foam 11 comes into axial abutment against the bottom of the housing 10 and is retained therein by means of a retaining ring 12 snap-fastened to the neck 5.

The inside surface 13 of the neck 5 extending downwards from the housing 10 is flared, diverging downwards, and defining an opening whose diameter is substantially greater than the maximum outside diameter of the applicator element 9.

The retaining ring 12 defines an opening 14 that is tapering, converging downwards to facilitate returning the applicator element 9 into the receptacle 2.

The block of foam 11 in the example shown in FIG. 1 is circularly cylindrical, and it has a circular section axial hole 15 passing through it of a diameter that is substantially equal to the outside diameter of the stalk 8, i.e. smaller than the maximum diameter of the applicator element 9.

Closure is sealed by tightening the end wall of the handle member 7 against the ring 12.

On examining FIG. 1 it will be observed that when the applicator 6 is in place in the receptacle 2, there is practically no volume of air above the block of foam 11. The stalk 8 is connected to the handle member via a flared portion 8' which is shaped to engage in the ring 12 until it comes into contact with the block of foam 11.

The wiper member may be made of a foam of an elastomer such as polyurethane or polyether, in particular.

The foam includes at least 5% of open cells, with the cells having a diameter that lies preferably in the range 5 $\mu$m to 3 mm.

The height of the block of foam 11 lies, for example, in the range 1.5 mm to 80 mm, and preferably in the range 5 mm to 30 mm.

The outside diameter of the block of foam lies, for example, in the range 8 mm to 30 mm, and preferably in the range 10 mm to 20 mm.

The flexibility of the block of foam 11 enables it to deform when the applicator element 9 passes therethrough so as to fit closely round the outline thereof and obtain effective wiping.

Figure 2:
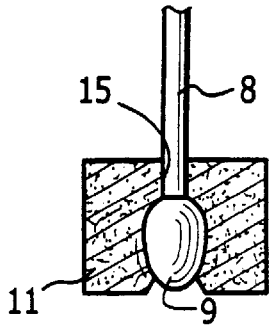
FIG. 2 is a view showing how the applicator element passes through the wiper member of the device shown in FIG. 1.

FIG. 2 shows how the block of foam 11 is deformed while the applicator element 9 is being returned or extracted.

By designing the axial hole 15 to have a section of diameter that is slightly less than or equal to the diameter of the stalk 8, the wiper member advantageously wipes not only the applicator element 9, but also the stalk 8 as it passes through the block of foam 11, thereby preventing makeup drying on the stalk 8 and forming a solid deposit that might subsequently flake off and pollute the makeup present in the receptacle.

Because of its porosity, the wiper member can remain impregnated in makeup so long as there remains any in the receptacle. Thus, when the makeup used is an aqueous formulation of polyurethane or acrylic resin, the wiper member remains sufficiently moist to prevent the resin from hardening within the receptacle, and it moistens the stalk and the applicator element as they pass through it.

The wiper member can thus simultaneously perform the following:

- mechanical wiping and cleaning action on the applicator element by surrounding it and wiping off excess makeup, together with any solid residue that may have resulted from the makeup drying in the event that it is in liquid or semiliquid form;
- absorption action by means of capillarity;
- absorption action by suction as the foam returns to its initial shape after being locally compressed by passage of the applicator element; and
- optionally impregnation action when the applicator element is filled to a lesser extent than is the wiper element.

The embodiment shown in FIGS. 1 and 2 is not limiting in any way.

Figure 3:
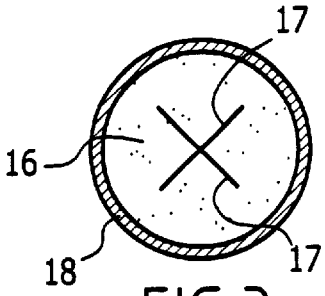
FIGS. 3 to 6 show various possible embodiments of the wiper member.

The block of foam 11 described with reference to FIGS. 1 and 2 may thus be replaced by a block of foam 16 as shown in FIG. 3 which does not have an axial hole passing through it but is cut through axially in a cross-formation to form through slots 17 suitable for moving apart while the applicator element 9 is passing through.

In a variant (not shown), the axial passage through the block of foam may include both a cylindrical hole and slots.

When the applicator is being withdrawn or put into place on the receptacle, the applicator element is liable to compress the foam axially before penetrating into it, particularly if the applicator element has a leading face that is flat or concave towards the outside.

The block of foam when compressed in this way tends to become more compact in the center, opposing greater resistance to penetration by the applicator element.

To prevent the block of foam from bunching up and making it difficult to return or extract the applicator element, it is advantageous to stiffen all or a portion of the height of the block of foam at the periphery thereof, e.g. by coating it in a settable resin that, once polymerized, forms a skin 18 preventing the block of foam from collapsing.

In a variant, or in addition, the periphery of the block of foam can be stuck or bonded to the inside surface of the neck of the receptacle.

Figure 4:
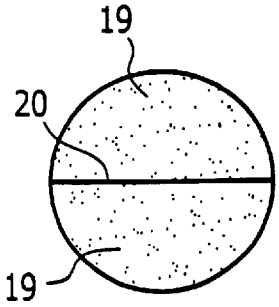
Figure 5:
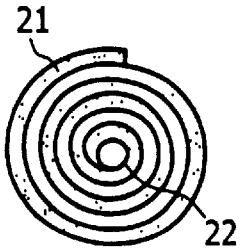

FIG. 4 shows a variant in which the wiper member is formed by uniting two solid foam half-cylinders 19 that are held against each other by the neck 5 of the receptacle and that define between them a slot 20 which can open to allow the applicator element 9 to pass through.

In another variant, the wiper member can be made by winding up a strip of foam 21 to define a central hole 22 through which the applicator element 9 passes.

The wiper member may also be made by superposing a plurality of washers of different kinds of foam.

Figure 6:
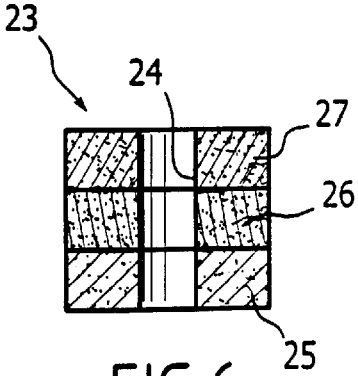

By way of non-limiting example, FIG. 6 shows a wiper member 23 constituted by three superposed washers 25, 26, and 27 made of foams having cell densities that increase on going towards the outlet of the receptacle, with the stack having an axial hole 24 passing through it for the applicator element 9.

Figure 7:
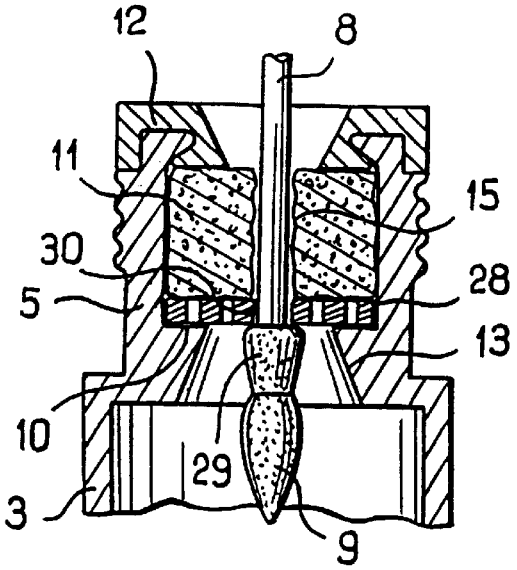
FIGS. 7 and 8 show a variant embodiment of the device shown in FIG. 1.
Figure 8:
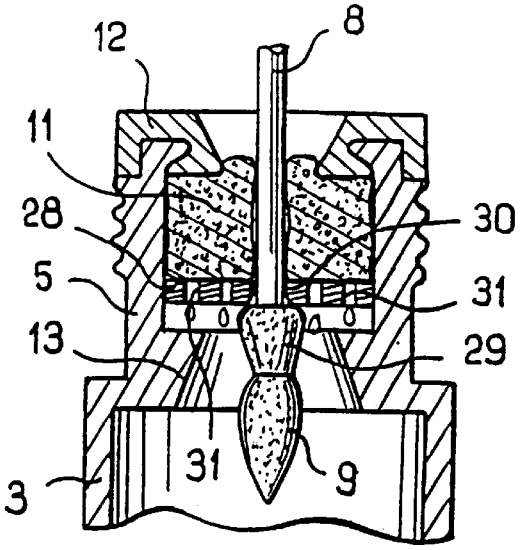

The wiper member may also comprise a block of foam 11 and a rigid disk 28 for wringing out the block of foam 11, as shown in FIGS. 7 and 8.

The wringing-out disk 28 can be disposed beneath the block of foam 11 being held in the neck 5 by a shoulder defining the bottom of the housing 10. It has a central hole 30 through which the applicator element 9 passes. In the example shown, the applicator element 9 is surmounted by a resilient projection 29 projecting from the stalk 8 and designed to press against the disk 28 when the applicator 6 is withdrawn from the receptacle.

The diameter of the hole 30 is smaller than the maximum diameter of the projection 29, such that the disk 28 is entrained upwards by the applicator, thereby compressing the block of foam 11 axially, thus wringing it out.

After the block of foam 11 has been compressed axially, the projection 29 can pass through the hole 20 by deforming elastically.

The disk 28 has through orifices 31 which enable excess makeup to run out into the receptacle on being expelled from the compressed block of foam 11.

The capacity of the block of foam 11 for absorption as the applicator element passes through it is thus increased.

The presence of the projection 29 makes it possible, where appropriate, to have an applicator element that is very flexible and incapable on its own, because of its flexibility, of causing the disk 28 to move upwards.

Although not shown in the figures, it is possible without going beyond the ambit of the invention to place an additional and conventional wiper member inside the receptacle located so as to have the applicator element pass through it prior to passing through the block of foam on extraction from the receptacle.

The wiper member can be held inside the receptacle in numerous different ways.

As mentioned above, the block of foam can merely be stuck or bonded via its periphery to the wall of the receptacle.

FIGS. 9 to 12 show various other ways in which the wiper member can be held, and where appropriate these can be combined with the block of foam being stuck or bonded to the receptacle.

Figure 9:
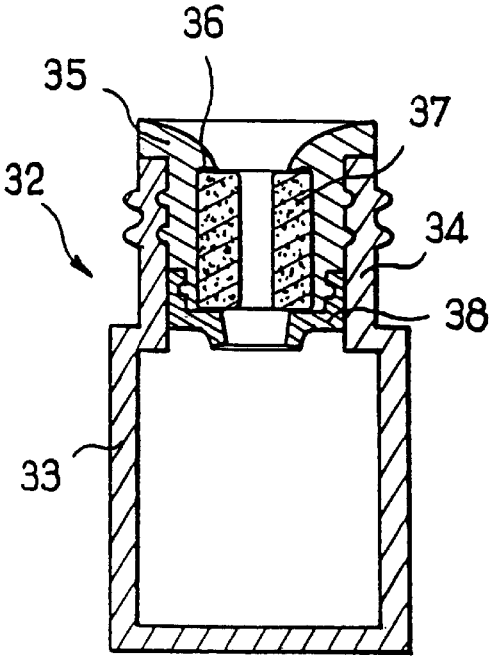
FIG. 9 is a diagrammatic axial section view of a device constituting a second embodiment of the invention.

FIG. 9 shows a device 32 comprising a receptacle 33 made by injection blow molding and an applicator that is not shown but that is identical to the applicator in the embodiment of FIG. 1.

The receptacle 33 has a neck 34 in which a sleeve 35 is snap-fastened, the inside of the sleeve having a shoulder for forming a housing 36 that receives a block of foam 37 from below, with the block being held in the sleeve 35 by a ring 38 snap-fastened to the bottom end of the sleeve 35.

The block of foam 37 and the holding ring 38 are put into place on the sleeve 35 before the sleeve is inserted in the neck 34 of the receptacle 33.

Figure 10:
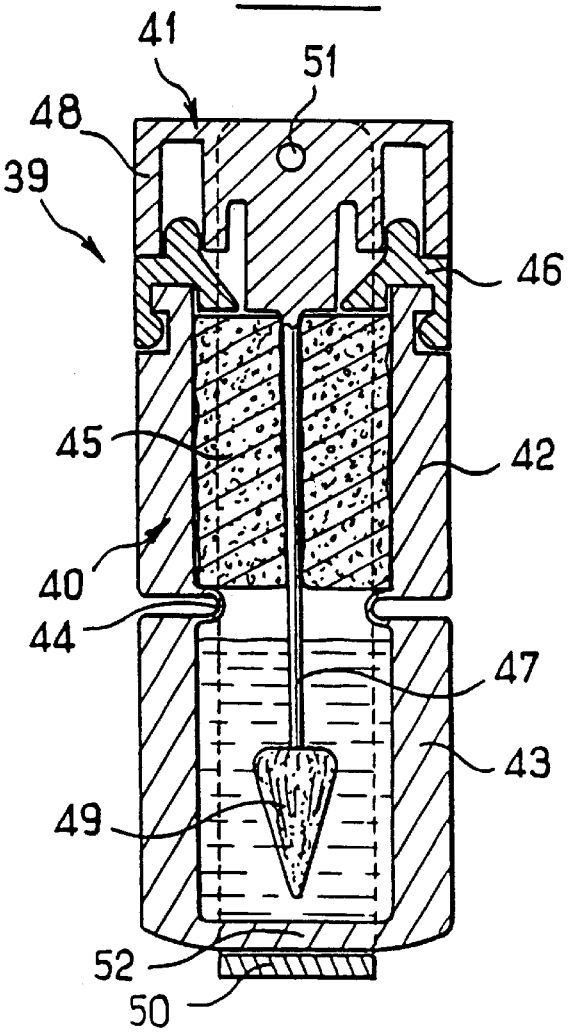
FIG. 10 is a diagrammatic axial section view of a device constituting a third embodiment of the invention.

FIG. 10 shows a device 39 comprising a receptacle 40 and an applicator 41.

The receptacle 40 comprises a two-part body comprising an upper part 42 and a lower part 43 inter-connected by a narrow annular wall 44 that is folded towards the inside of the receptacle and forms a narrower section therein on which there rests the bottom end of a block of foam 45 serving as the wiper member. The top end of the block of foam 45 is retained by a ring 46 snap-fastened to the free end of the upper portion 42 of the receptacle 40.

The applicator 41 comprises a stalk 47 provided at one end with an applicator member 49 and at its other end with a handle member 48 suitable for engaging on a neck formed on the top of the ring 46.

The handle member 48 also has a loop 50 that pivots about a stub axle 51 and that is capable in a first position of engaging against the outside face of the bottom 52 of the receptacle to retain the applicator 41 on the ring 46, thereby closing the receptacle 40, and in a second position, diametrically opposite to the first position, to serve as a long handle making the applicator easier to use.

The wall 44 is flexible to some extent, thereby enabling the portions 42 and 43 to be moved towards each other to allow the loop 50 to be put into the receptacle-closing position. When the receptacle is released, the resilience of the wall 44 tends to cause it to return to its initial shape thus moving apart the upper and lower portions 42 and 43, thus ensuring that the lower portion 43 exerts a certain amount of contact pressure against the loop 50 which is thus prevented from pivoting freely.

The ring 46 has a top sealing lip which fits on closure in a bottom groove in the handle member 48.

Figure 11:
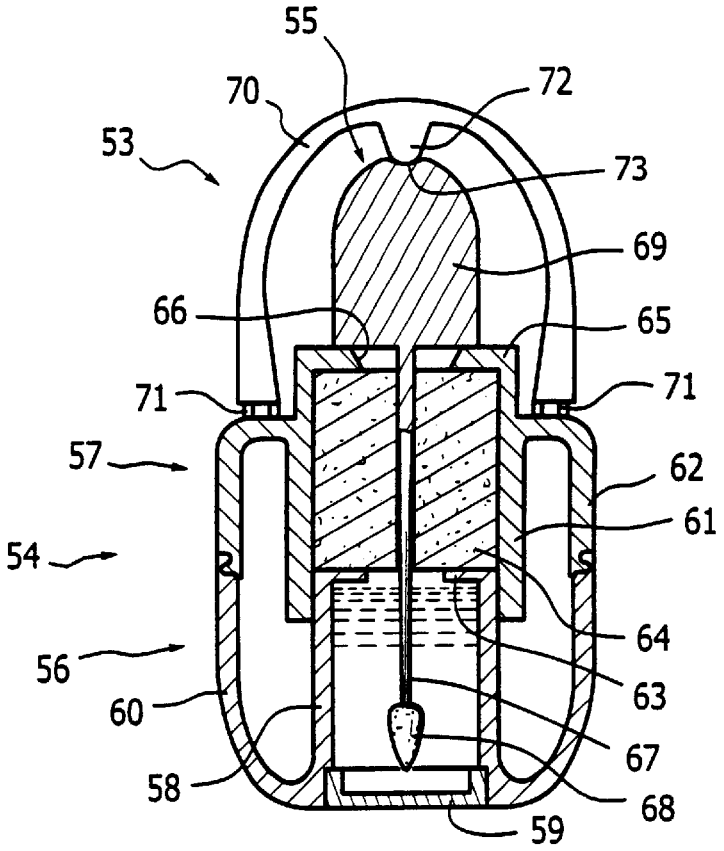
FIG. 11 is a diagrammatic axial section view of a device constituting a fourth embodiment of the invention.

FIG. 11 shows a device 53 constituting a fourth embodiment of the invention. This device 53 comprises a double-walled receptacle 54 and an applicator 55.

The receptacle 54 is formed by assembling together a lower portion 56 and an upper portion 57.

The lower portion 56 has a central tubular wall 58 that is closed at its bottom end by an add-on bottom 59, and that is extended radially outwards and upwards from its bottom end by an outer skirt 60. The central tubular wall 58 has an inwardly-directed rim 63 at its top end.

The top portion 57 comprises a central tubular wall 61 that is extended outwards and downwards by an outer skirt 62 which is shaped to snap-fasten at its bottom end in the outer skirt 60 so as to obtain a receptacle having a continuous outside surface. The central tubular wall 61 is provided at its top end with an inwardly-directed rim 65.

The wall 58 engages in leakproof manner in the wall 61 and contains the cosmetic to be dispensed.

The rim 63 serves as a support for the bottom end of a block of foam 64 that serves as the wiper member, occupying substantially all of the volume inside the central tubular wall 61 between the rims 63 and 65. The block of foam 64 is thus retained in the upper portion 57 by the lower portion 56.

The applicator 55 comprises a stalk 67 fitted at one end with an applicator element 68 and secured at its other end to a handle member 69.

A loop 70 is hinged to the upper portion 57 of the receptacle 54 so as to hold the handle member 69 pressed against the rim 65 when the applicator is not in use, thereby closing the receptacle 54 in leakproof manner.

The outer skirt 62 is connected to the central tubular wall 61 via an annular portion that extends substantially perpendicularly to the longitudinal axis of the stalk 67, and the loop 70 pivots on this annular portion by means of hinges 71. The top of the loop 70 has a projection 72 that extends inwardly and that is suitable for engaging in a recess 73 formed in the top of the handle member 69, so as to hold it pressed against the rim 65.

The rim 65 defines a tapering opening 66 that converges towards the inside of the receptacle.

When the receptacle is made of a transparent plastics material, the double wall gives the user the impression that the receptacle has a thick wall, e.g. made of thick glass, thereby improving the appearance of the receptacle.

Figure 12:
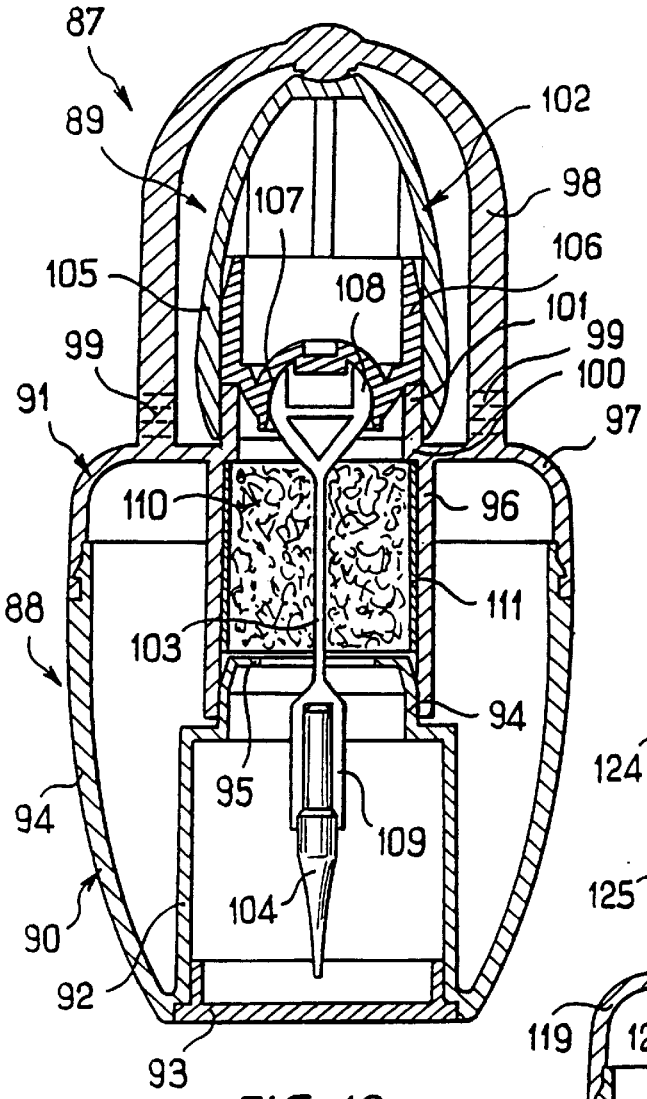
FIG. 12 is a diagrammatic axial section view of a device constituting a fifth embodiment of the invention.

FIG. 12 shows a device 87 constituting a fifth embodiment of the invention.

This device comprises a receptacle 88 and an applicator 89.

The receptacle 88 is formed by assembling together a lower portion 90 and an upper portion 91.

The lower portion 90 has a central tubular wall 92 that is closed at the bottom by an add-on bottom wall 93 and that is extended upwards from its bottom end by an outer skirt 94 that is upwardly concave.

The tubular wall 92 has a shoulder in its top portion and it is terminated by a rim 95 projecting radially inwards.

The top portion 91 of the receptacle 88 comprises a central tubular wall 96 that is extended radially outwards in the vicinity of its top end by an outer skirt 97 which is downwardly rounded with the outer skirt 94 of the lower portion 90 snap-fastening to the inside surface thereof. The tubular central wall 96 then engages in leakproof manner on the top portion of the tubular central wall 92.

A loop 98 integrally molded with the upper portion 91 of the receptacle is hinged to the outer skirt 97 by means of hinge-forming bridges of material 99.

Where it joins the outer skirt 97, the tubular central wall 96 has an inwardly-directed setback 100 that is upwardly extended by a neck 101.

The applicator 89 comprises a handle member 102, that is extended downwards by a stalk 103 provided at its bottom end with an applicator element 104.

The handle member 102 comprises an assembly of a dome-shaped outer body 105 that is open at its bottom end, and an inner portion 106 engaged in the outer body 105 and presenting a hollow housing 107 retaining a spherical head 108 formed at the top end of the stalk 103 so as to constitute a ball-and-socket joint.

When the receptacle 88 is in its closed position, the outer body 105 of the handle member 102 fits on the neck 101.

Sealing on closure is obtained by clamping the inner portion 106 against the top end edge of the neck 101.

The stalk 103 of the applicator 89 flares at its bottom end 109 to form a housing to which the applicator element 104 is fixed, with said element being constituted in this example by a felt tip.

The block of foam 110 is housed inside the central tubular-wall 96 by being held axially at its bottom end by the inner rim 95 and at its top end by the setback 100.

The periphery of the block of foam 110 is coated in a relatively rigid skin 111 for preventing it from collapsing when the enlarged portion 109 of the stalk 103 passes therethrough, in the same manner as that described above with reference to FIG. 3.

In the embodiments described above, the block of foam that acts as the wiper member occupies only the top portion of the inside of the receptacle.

Figure 13:
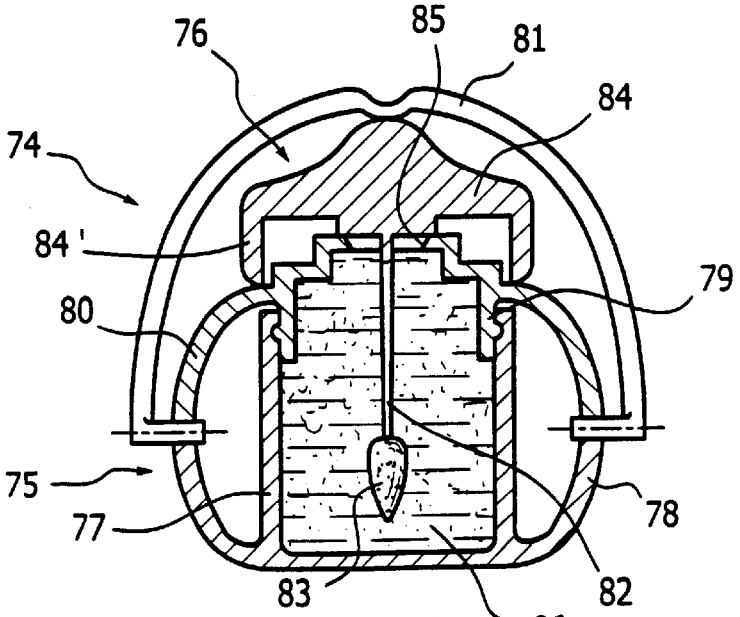
FIG. 13 is a diagrammatic axial section view of a device constituting a sixth embodiment of the invention.
Figure 14:
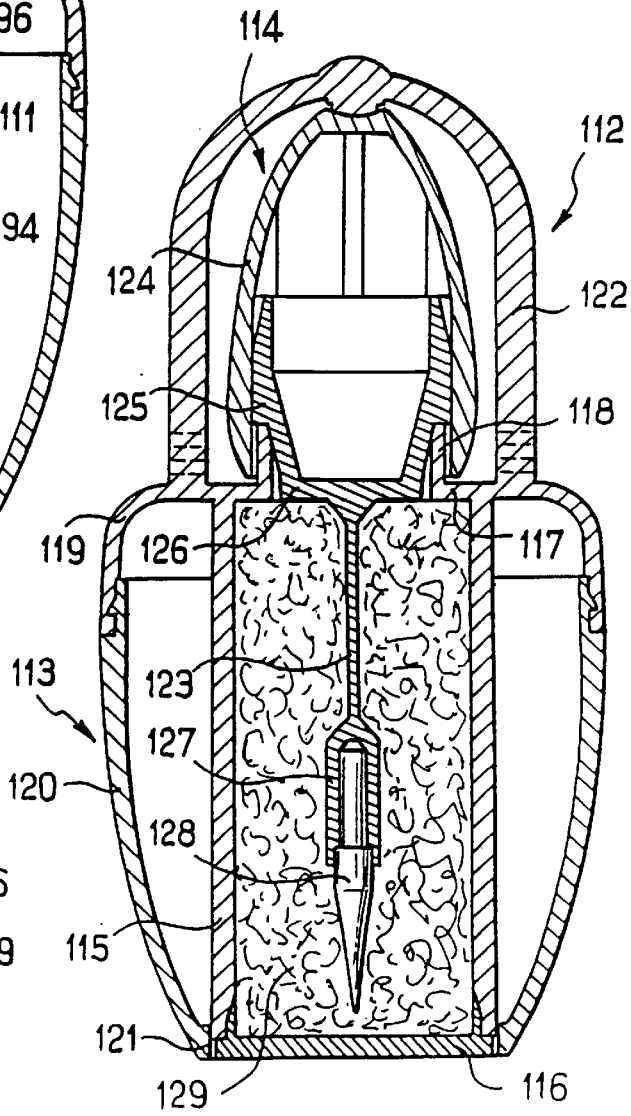
FIG. 14 is a diagrammatic axial section view of a device constituting a seventh embodiment of the invention.

With reference to FIGS. 13 and 14, there follows a description of two embodiments of the invention in which the block of foam occupies substantially all of the inside volume of the receptacle.

FIG. 13 shows a device 74 constituting a fixed embodiment of the invention. This device 74 comprises a receptacle 75 and an applicator 76.

The receptacle 75 comprises an upper portion 79 and a lower portion having a central tubular wall 77 closed at its bottom end and extended upwardly and outwardly therefrom by an outer skirt 78.

The upper portion 79 has a central tubular wall which is snap-fastened in the tubular wall 77 and an outer skirt 80 extending downwards around the tubular wall 77 and pressing against the free edge of the outer skirt 78.

Semicircular notches are formed in the edges of the outer skirts 78 and 80 that come into contact so that after the lower and upper portions of the receptacle have been assembled together they constitute holes for rotatably receiving the ends of a loop 81.

The applicator 76 comprises a stalk 82 provided at one end with an applicator element 83 and secured at its other end to a handle member 84 which, when the applicator is not in use, is held in place on the upper portion 79 by the loop 81. The top of the upper portion 79 has a through opening 85 of diameter greater than the maximum diameter of the applicator element 83.

The inside of the receptacle 75 is fully occupied by a block of foam 86 that has an axial hole or that is cut so as to receive the stalk 82 and the applicator element 83 when the applicator 76 is in place on the receptacle 75.

The cosmetic to be dispensed impregnates to saturation point at least the bottom portion of the block of foam 86 in contact with the applicator element 83 when the receptacle is closed by the applicator.

The top portion of the block of foam 86 then acts as the wiper member.

The handle member 84 has an outer skirt 84 ' which, when the receptacle is closed, presses against the top portion thereof.

The closed receptacle is sealed by the above-mentioned outer skirt and the central portion of the handle member to which the stalk 82 is connected both pressing simultaneously against the top face of the receptacle surrounding the opening 85.

FIG. 14 shows a device 112 comprising a receptacle 113 and an applicator 114.

The receptacle 113 has a central tubular wall 115 that is closed at its bottom end by an add-on bottom wall 116.

The central tubular wall 115 has an inwardlydirected setback 117 at its top end which is upwardly extended by a neck 118.

The central tubular wall 115 is extended radially outwards level with the setback 117 by an outer skirt 119 that curves downwards.

A tubular cover 120 that is upwardly concave is snap-fastened to the bottom end of the outer skirt 119.

The bottom end of the cover 120 has a hole 121 passing therethrough which fits around the bottom end of the tubular wall 115, with the outside face of the bottom wall 116 being flush within the bottom annular surface of the cover 120 surrounding the outside of said hole.

A retaining loop 122 is hinged to the skirt 119 like the above-described loop 98.

The applicator 114 comprises a handle member that is extended downwards by a stalk 123.

The handle member comprises an outer body 124 identical to the outer body 105 of the handle member 89 described above, and an inner portion 125 to which the stalk 123 is fixed and also serving to close the receptacle in sealed manner while it is not in use.

The inner portion 125 co-operates with the outer body to form a downwardly open annular groove in which the neck 118 engages when the handle member is in place on the receptacle.

The inner portion 125 is upwardly flared to a small extent so as to engage easily in the opening of the neck 118 while still being capable of pressing closely against the inside surface thereof once inserted on the neck 118 so as to ensure that the receptacle is closed in sealed manner.

The bottom of the inner portion 125 is defined by a plane wall 126 occupying nearly all of the inside section of the neck 118, with the stalk 123 connected thereto. The bottom of the stalk is provided with an enlarged portion 127 to which the applicator element 128 is fixed in identical manner to that described with reference to FIG. 12.

The inside volume of the central tubular wall 115 is substantially completely occupied by a block of foam 129, as in the embodiment of FIG. 13.

The block of foam 129 may have an axial hole for receiving the stalk and the applicator element, or it may merely be cut through axially.

When the applicator is in place on the receptacle, it is advantageous for the wall 126 to come flush with the top face of the block of foam since that ensures that no drying takes place along the entire length of the stalk 123 thus preventing any solid deposit forming thereon which might subsequently flake off.

Figure 15:
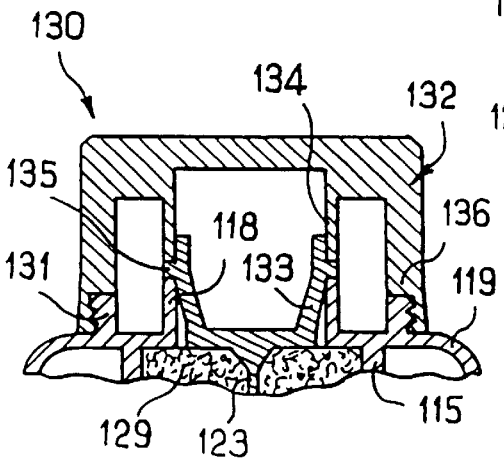
FIG. 15 is a fragmentary diagrammatic axial section view of a device constituting an eighth embodiment of the invention.

FIG. 15 shows a device 130 constituting an eighth embodiment of the invention.

The device 130 has a bottom portion that is identical to that shown in FIG. 14, and comprises a receptacle that differs from the receptacle 113 by omission of the loop 122 which is replaced by a skirt 131 having an outside thread.

The device 130 comprises an applicator 132 constituted by a handle member and by an applicator stalk 123 whose bottom portion is identical to that described with reference to FIG. 14.

The stalk 123 is connected to an internal portion 133 fixed to the bottom end of an internal tubular skirt 134 of the handle member.

An outer collar 135 limits insertion of the internal portion 133 into the skirt 134.

The handle member comprises an outer tubular skirt 136 coaxial with the internal skirt 134 and having an inside thread for screw engagement on the skirt 131 of the receptacle.

When the handle member is screwed onto the receptacle, the collar 135 is pressed against the top edge of the neck 118 to close the receptacle in sealed manner.

It is advantageous for the thread of the skirt 131 to be remote from the neck 118 since that prevents any makeup being deposited on the neck 118 which could prevent the receptacle from being closed by dirtying the threads of the skirts 131 and 136, with the gap left between the opening of the receptacle and the threads optionally serving to collect an overflow of makeup.

Figure 16:
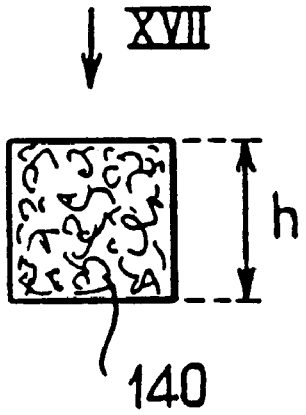
FIG. 16 is a side elevation view of a block of foam used as the wiper member, and shown in the non-compressed state.

FIG. 16 shows a block of foam 140 of height h used as a wiper member.

Figure 17:
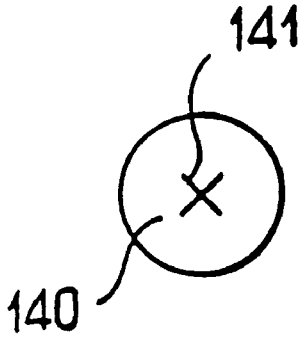
FIG. 17 is a view of the block of foam shown in FIG. 16, as seen from above, showing a cross-shaped slot passing axially through the block of foam.

As can be seen on examining FIG. 17, the block of foam is split axially by a cross-shaped split 141 to form a passage through which the applicator element passes.

As a function of the type of applicator element used, or as a function of the kind of substance contained in the receptacle, it may be desirable to exert radial force to a greater or lesser extent on the applicator element as it passes through the wiper member.

It is thus possible to select foams of open cell structure of varying degrees of hardness.

Advantageously, it is possible to use only one type of open cell structure foam, and to compress the foam axially to a greater or lesser extent depending on the amount of friction that is to be exerted on the applicator element.

Figure 18:
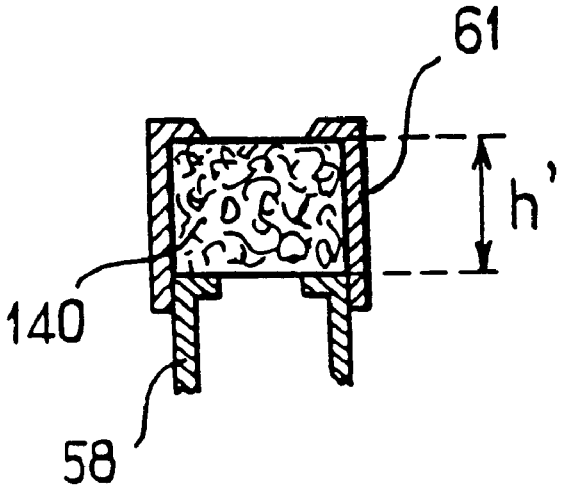
FIG. 18 shows the FIG. 16 block of foam compressed axially when in place in the receptacle.

Thus, as shown in FIG. 18, if the block of foam 140 shown in FIG. 16 is compressed axially by being placed in a housing of the receptacle, e.g. of the kind provided by assembling together the walls 58 and 61 in the embodiment of FIG. 11, then the density of the foam is increased and consequently the radial forces exerted on the applicator element are also increased. By acting on the extent to which the wall 58 is engaged within the wall 61, it is possible to adjust the height h' to a value that imparts the desired density to the foam.

Figure 19:
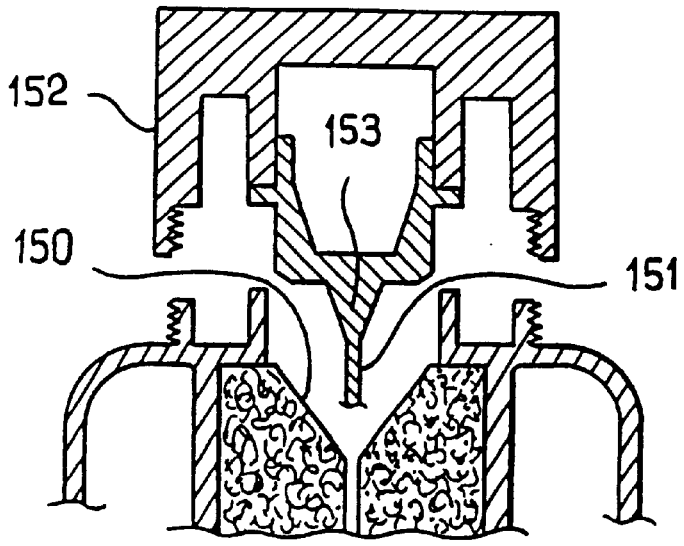
FIG. 19 shows a particular way of embodying the block of foam.

In its top portion, the block of foam may have a conical recess 150 as shown in FIG. 19 so as to facilitate insertion of the applicator element.

The stalk 151 (shown in part only) supporting the applicator element preferably connects to the handle member 152 via a flared portion 153 that is designed to fit in the recess 150 when the applicator element is in place inside the receptacle, thereby limiting the volume of air above the block of foam.

Figure 20:
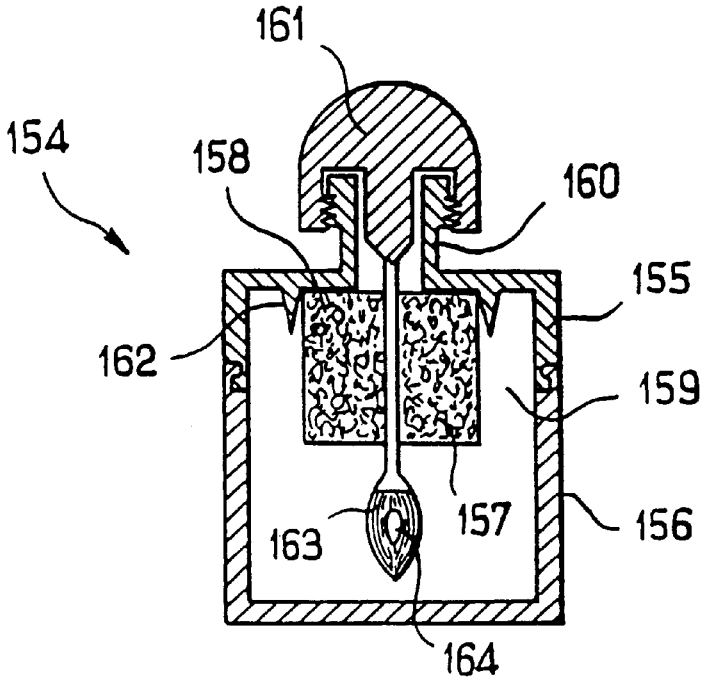
FIG. 20 is a diagrammatic axial section view of a device constituting a ninth embodiment of the invention.

FIG. 20 shows a device 154 constituting a ninth embodiment of the invention.

The device 154 comprises a receptacle constituted by assembling together an upper portion 155 and a lower portion 156, the upper portion 155 including an outwardly threaded neck 160 onto which the handle member 161 of the applicator is screwed.

A block of foam 157 including at least 5% of open cells is secured by adhesive or by heat-sealing via its top face 158 to a shoulder situated at the base of the neck 160, inside a centering and sealing skirt 162, with the inside diameter of the skirt corresponding substantially to the outside diameter of the block of foam 157 and with the height of the skirt constituting about one-fourth the height of the block of foam 157.

By way of example, this figure shows an applicator element in the form of a hollow body 163 having a cavity 164 suitable for housing a supply of makeup.

The upper portion 155 of the receptacle is shaped so as to leave an annular gap 159 around the block of foam 157 and the skirt 162, thereby allowing the foam to deform axially and radially when the applicator element 163 passes therethrough.

Figure 21:
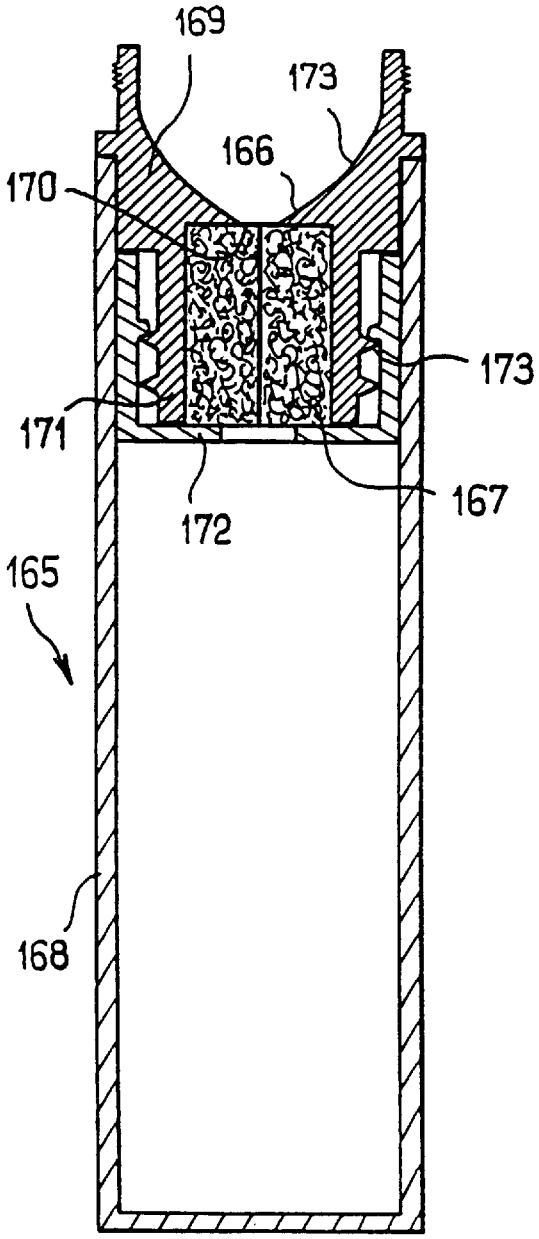
FIG. 21 is a diagrammatic axial section view of a device constituting a tenth embodiment of the invention.

FIG. 21 shows a fragment of a device 165 constituting a tenth embodiment of the invention.

The applicator is not shown and can be constituted by any type adapted to the use for which it is intended.

The device 165 has the special feature of including a wiper lip 166 in addition to the wiper member constituted by a block of foam 167 that is split axially and that has at least 5% of open cells.

The device 165 comprises a cylindrical receptacle 168 and the wiper lip 166 is formed in an endpiece 169 which is inserted in the top portion of the receptacle 168.

The wiper lip 166 covers a portion of the top face 170 of the block of foam 167, leaving a passage of diameter adapted to the nature and the shape of the applicator element.

The endpiece 169 comprises a tubular wall 171 defining a cylindrical housing in which the block of foam 167 is received.

The block of foam is held in place inside said housing by a retaining piece 172 having a generally U-shaped axial section with the upper portion thereof being housed in an annular gap left between the wall 171 and the receptacle 168, and snap-fastened thereto by engaging relief 173 on the wall 171. The retaining piece 172 has a central hole through which the applicator element passes.

The endpiece 169 is shaped to guide the applicator element when it is returned into the receptacle 168, and it has a surface 173 that converges towards the wiper lip 166.

Figure 22:
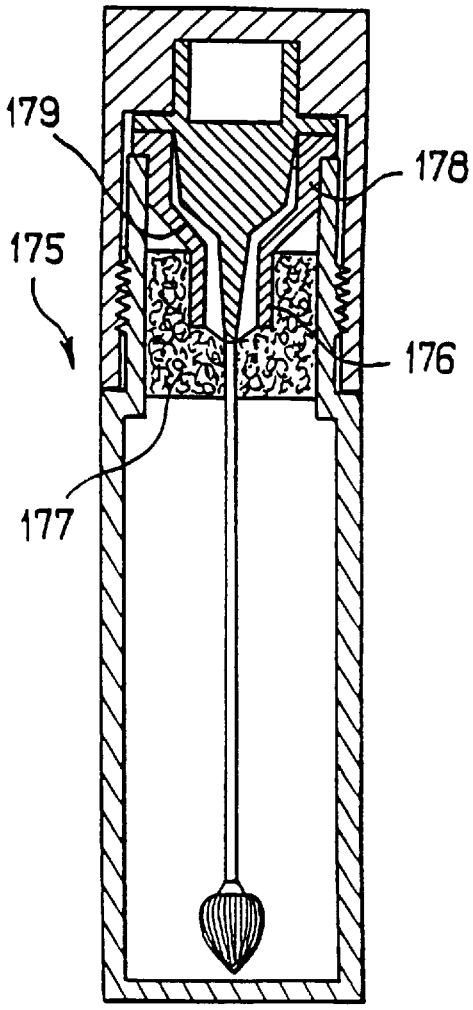
FIG. 22 is a diagrammatic axial section view of a device constituting an eleventh embodiment of the invention.

FIG. 22 shows a device 175 constituting an eleventh embodiment of the invention.

As in the preceding embodiment, this device has a wiper lip 176 in addition to a block of foam 177 that has at least 5% of open cells.

The wiper lip 176 is formed in an endpiece 178 which is inserted in the neck of the receptacle.

The wiper lip is extended upwards by a flared wall 179 which acts as a guide while the applicator element is being returned.

The block of foam 177 is open in its top portion so that a part thereof engages around the wiper lip 176.

As in the preceding embodiment, the presence of a wall for guiding the applicator element towards the center of the block of foam makes it possible while the applicator is being returned to prevent damage to the applicator element, in particular when the outside diameter of the block of foam is relatively small.

If no such guidance is provided, then the applicator element runs the risk of being presented remotely from the center of the block of foam containing the axial hole or the slots that enable it to pass through the block of foam. A relatively large amount of force could then be applied to the applicator element to make it pass into the block of foam, particularly if the block of foam is small in diameter.

Under such circumstances, since the periphery of the block of foam is fixed to a rigid wall, it deforms with difficulty to form a hollow for guiding the applicator element towards the center of the block of foam.

In the embodiments described with reference to FIGS. 21 and 22, the block of foam is stuck or bonded to the endpiece 169 and 178, e.g. made of polyethylene or polypropylene.

Prior to being fixed thereto, the block of foam may receive suitable surface treatment.

In the embodiments described, the receptacle can be filled before the wiper member is put into place, or after. If it is filled after, it is even possible to take advantage of the porosity of the foam to fill the receptacle through the foam.

The devices described above are advantageously sold with the applicator in place in the receptacle.

Figure 23:
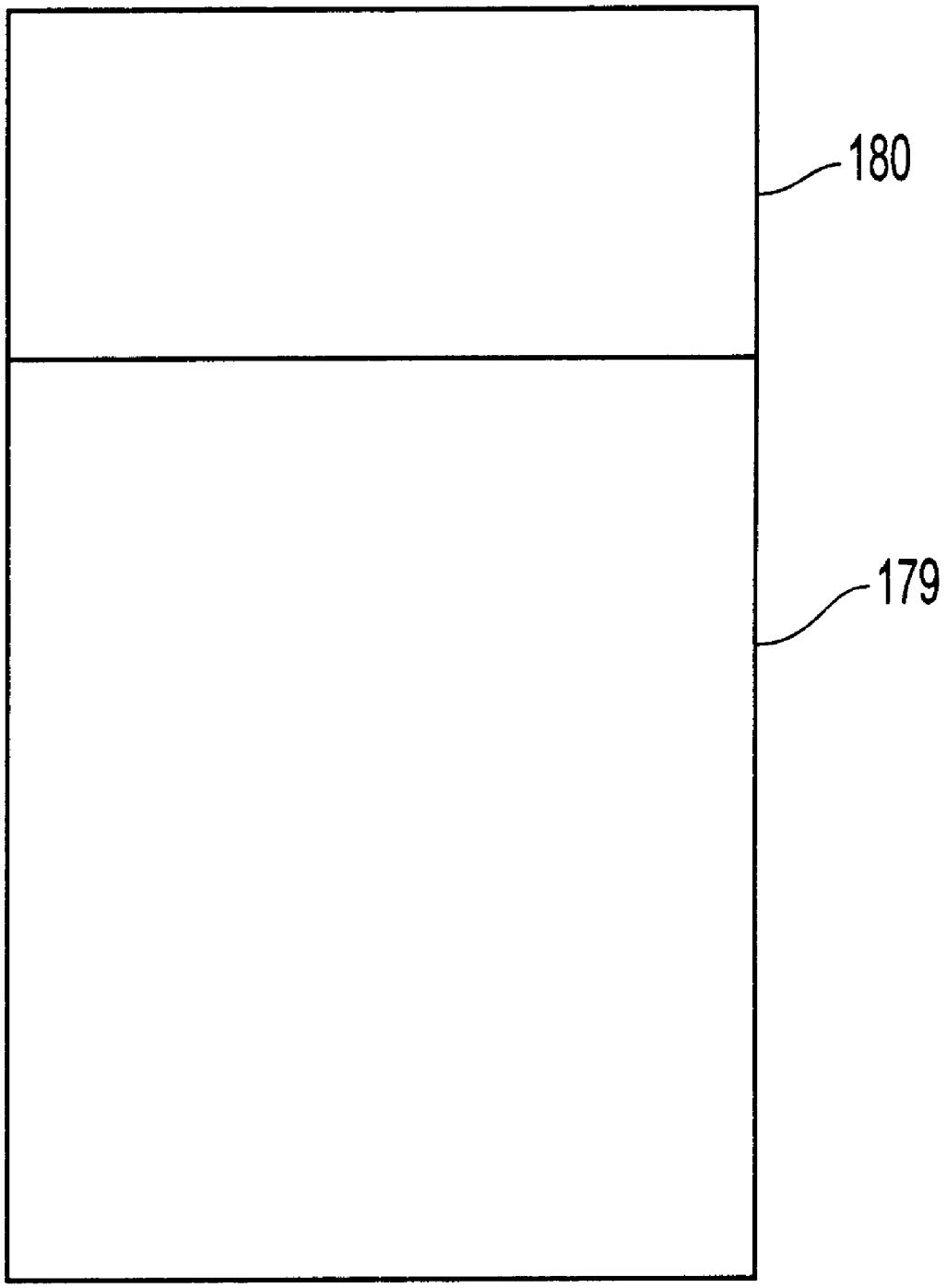
FIG. 23 shows a receptacle provided with a closure capsule according to the invention.

Nevertheless, it is also possible to sell the receptacle and the applicator separately, in which case the receptacle is provided with a closure capsule that is replaced, in use by the applicator. FIG. 23 shows such a receptacle 179 provided with a closure capsule 180.

Under such circumstances, a receptacle sold separately constitutes a refill element for replacing an empty receptacle, with the same applicator being retained.

Finally, the invention makes it possible to wipe the applicator element in particularly satisfactory manner and contributes to obtaining makeup that is well done. Where necessary, a small mirror can be fixed to the outer wall of the receptacle.

Where appropriate, the invention also makes it possible to wipe an applicator element whose maximum diameter is less than or equal to that of the stalk of the applicator, which is not possible with prior art wiper members. Because of its high degree of deformability, foam can press against the stalk and wipe the stalk so as to prevent a solid deposit forming thereon that could subsequently flake off, while simultaneously providing effective wiping of the applicator element, even if the diameter of the applicator element is greater than or less than the diameter of the stalk.

The invention also makes it impossible to improve the extent to which the receptacle is emptied insofar as the deformability of the wiper member makes it possible to tilt the stalk of the applicator so as to bring the applicator element into a position, as shown in dashed lines in FIG. 1, where it can pick up makeup from regions of the inside surface of the receptacle that are inaccessible in the prior art.

Although the rest position of the applicator stalk in all of the embodiments described is rectilinear, it is possible to use a stalk that is curved without going beyond the ambit of the invention and taking advantage of the fact that because of its deformability the wiper member makes it possible to engage a curved stalk in the receptacle.

Advantageously, the invention also makes it possible to use an applicator element whose cross-section is not circularly symmetrical in shape, being oval, square, or some other shape.

The applicator member also constitutes a filter that is particularly effective at retaining any makeup residue that might have dried and become deposited on the applicator element or on the stalk of the applicator.

Because the foam is porous, the invention also makes it possible to avoid making a popping noise when the applicator element passes through the wiper member.

The invention is preferably applied to packaging and applying a substance that is liquid or semiliquid.

Nevertheless, the ambit of the invention also extends to a substance that is in powder form.

What is claimed is:

1. A device for packaging and applying a substance, in particular a cosmetic, the device comprising a receptacle that is open at one end and has a bottom, said receptacle being suitable for containing said substance to be applied, and an applicator comprising a stalk provided at one end with an applicator element and at its other end with a handle member, said applicator closing said receptacle, the applicator element being housed in the receptacle when the receptacle is closed and being withdrawn therefrom in contact with an elastically deformable wiper member, wherein said wiper member is spaced from the bottom of said receptacle, the substance is freely contained in a space between said bottom and said wiper member, wherein said wiper member is constituted at least in part by a block of foam, wherein said block of foam is substantially closed at rest and opens when the applicator element passes therethrough.

2. A device according to claim 1, wherein the foam is in contact with the stalk of the applicator when the applicator is in place in the receptacle.

3. A device according to claim 1, wherein the foam is disposed so an to be in contact with the portion of the stalk that is adjacent to the handle member when the applicator is in place in the receptacle.

4. A device according to claim 1, wherein said wiper member comprises a block of foam that is stiffened at its periphery and over at least a portion of its height.

5. A device according to claim 1, wherein the talk of the applicator has a middle portion and a portion adjacent to the applicator element, the outside diameter of said portion adjacent to the applicator element being greater than that of said middle portion.

6. A device according to claim 1, wherein said substance is a liquid and said elastically deformable wiper member is constituted entirely by a block of foam.

7. A device according to claim 1, wherein the stalk of the applicator is rectilinear, and wherein the receptacle is elongate in shape, having a mouth with an opening of a width that is sufficiently large to enable the stalk to be tilted inside the receptacle through at least 10° relative to the longitudinal axis of the receptacle.

8. A device according to claim 1, wherein the wiper member includes a rigid disk suitable for being entrained by the applicator while being withdrawn for the purpose of wringing out said foam.

9. A device according to claim 1, wherein the wiper member comprises a plurality of blocks of foam of different densities.

10. A device according to claim 1, wherein the wiper member is hold axially inside the receptacle by a narrow portion constituted by an inwardly folded flexible annular wall integrally formed with the receptacle by molding.

11. A device according to claim 1, wherein the receptacle is formed by assembling two portions, the wiper member being hold axially in one of said portions by the other portion.

12. A device according to claim 1, wherein the wiper member is split axially.

13. A device according to claim 12, wherein the wiper member has an axial hole in its center.

14. A device according to claim 1, further including a wiper lip.

15. A device according to claim 14, wherein the wiper lip is situated at an outer mouth of the receptacle and wherein it is extended outwards by a wall that flares away from the foam.

16. A device according to claim 1, wherein the foam has a tapering hole.

17. A device according to claim 1, wherein the handle member is suitable for closing the receptacle in sealed manner when it is in place thereon.

18. A device according to claim 1, wherein the handle member is suitable for being screwed onto a thread of the receptacle, the diameter of the thread being significantly greater than the diameter of the opening of the receptacle.

19. A device according to claim 1, wherein the receptacle has a double wall.

20. A device according to claim 1, wherein the stalk of the applicator has a diameter lying in the range 0.2 mm to 0.5 mm.

21. A device according to claim 1, wherein the applicator element in a brush.

22. A device according to claim 1, wherein the foam is situated in a housing of the receptacle of height h' that is smaller than the axial size h of the foam prior to being mounted in the receptacle.

23. The device of claim 1, the block of foam having an upper face and being fixed only by the upper face to the receptacle.

24. A device for packaging and applying a substance, in particular a cosmetic, the device comprising a receptacle that is open at one end and containing said substance to be applied, and an applicator comprising a stalk provided at one end with an applicator element and at its other end with a handle member, the applicator element being housed in the receptacle when the receptacle is closed by said applicator and being withdrawn therefrom in contact with an elastically deformable wiper member, wherein said wiper member is constituted at least in part by a block of foam, comprising at least 5% of open cells, wherein said block of foam is cut through or pierced to define a passage that is substantially closed when the applicator element is outside the receptacle and wherein said block of foam has a bottom end that is facing a surface of the substance in the receptacle.

25. A device for packaging and applying a liquid substance, in particular a cosmetic, the device comprising a receptacle that is open at one end and suitable for containing said substance, and an applicator comprising a stalk provided at one end with an applicator element and at its other end with a handle member, the applicator element being housed in the receptacle when the receptacle is closed and being withdrawn therefrom in contact with an elastically deformable wiper member, wherein said wiper member is constituted at least in part by a block of foam comprising at least 5% of open cells said block of foam is substantially closed at rest and opens when the applicator element passes therethrough, and wherein the applicator element is a brush.

26. A device for packaging and applying a substance, in particular a cosmetic, the device comprising a receptacle that is open at one end and suitable for containing said substance to be applied and an applicator comprising a stalk provided at one end with an applicator element and at its other end with a handle member, the applicator element being housed in the receptacle when the receptacle is closed by said applicator and being withdrawn therefrom in contact with an elastically deformable wiper member, wherein said wiper member is constituted at least in part by a block of foam comprising at least 5% of open cells, wherein said block of foam is cut through or pierced to define at least one slit that is, at rest, substantially closed when the applicator element is outside the receptacle, at least a portion of said stalk having a cross-section such that said block of foam is not substantially compressed when said portion is placed into said slit.

27. A device according to claim 26, wherein the receptacle contains the substance to be applied.

28. A device according to claim 24, wherein the receptacle contains the substance to be applied.

29. A device according to claim 1, wherein the receptacle contains the substance to be applied.

30. A device for packaging and applying a substance, in particular a cosmetic, the device comprising a receptacle that has an open end and a bottom, said receptacle suitable for containing said substance to be applied, and an applicator comprising a stalk provided at one end with an applicator element and at its other end with a handle member, the applicator element being housed in the receptacle when the receptacle is closed and being withdrawn therefrom in contact with an elastically deformable wiper member, wherein said wiper member is spaced from the bottom of said receptacle, the substance is freely contained in a space between said bottom and said wiper member, wherein said wiper member is constituted at least in part by a block of foam, wherein said block of foam is substantially closed at rest and opens when the applicator element passes therethrough, and wherein the open end of the receptacle is closed by said applicator.

31. A device according to claim 30, wherein the handle member is suitable for closing the receptacle in a sealed manner with respect to the substance contained in the receptacle, when it is in place thereon.

32. A device for packaging and applying a substance, in particular a cosmetic, the device comprising a receptacle that is open at one end and has a bottom, said receptacle being suitable for containing said substance to be applied, and an applicator comprising a stalk provided at one end with an applicator element and at its other end with a handle member, the applicator element being housed in the receptacle when the receptacle is closed and being withdrawn therefrom in contact with an elastically deformable wiper member, wherein said wiper member is spaced from the bottom of said receptacle, the substance is freely contained in a space between said bottom and said wiper member, wherein said wiper member is constituted at least in part by a block of foam comprising at least 5% of open cells, wherein said block of foam is substantially closed at rest and opens when the applicator element passes therethrough, and said foam having a tapering hole.

33. A device for packaging and applying a substance, in particular a cosmetic, the device comprising a receptacle that is open at one end and has a bottom, said receptacle being suitable for containing said substance to be applied, and an applicator comprising a stalk provided at one end with an applicator element and at its other end with a handle member, the handle member being suitable for closing the receptacle in a sealed manner when it is in place thereon, the applicator element being housed in the receptacle when the receptacle is closed and being withdrawn therefrom in contact with an elastically deformable wiper member, wherein said wiper member is spaced from the bottom of said receptacle, the substance is freely contained in a space between said bottom and said wiper member, wherein said wiper member is constituted at least in part by a block of foam comprising at least 5% of open cells, wherein said block of foam is substantially closed at rest and opens when the applicator element passes therethrough.

34. A device for packaging and applying a substance, in particular a cosmetic, the device comprising a receptacle that is open at one end and has a bottom, said receptacle being suitable for containing said substance to be applied, and an applicator comprising a stalk provided at one end with a brush and at its other end with a handle member, the brush being housed in the receptacle when the receptacle is closed and being withdrawn therefrom in contact with an elastically deformable wiper member, wherein said wiper member is spaced from the bottom of said receptacle, the substance is freely contained in a space between said bottom and said wiper member, wherein said wiper member is constituted at least in part by a block of foam comprising at least 5% of open cells, wherein said block of foam is substantially closed at rest and opens when the brush passes therethrough.

35. A device for packaging a substance, in particular a cosmetic, the device comprising a receptacle that is open at one end and has a bottom, the receptacle being suitable for containing the substance, an elastically deformable wiper member fitted to the receptacle, the wiper member being spaced from the bottom of the receptacle, the substance is freely contained in a space between said bottom and said wiper member, the wiper member being constituted at least in part by a block of foam which is substantially closed at rest, and a removable closure capsule for the receptacle, said wiper member, in a removed position of the closure capsule, being fixedly mounted on the receptacle.

36. A device for packaging and applying a substance, in particular a cosmetic, the device comprising a receptacle that is open at one end and has a bottom, said receptacle being suitable for containing said substance to be applied, and an applicator comprising a stalk provided at one end with an applicator element and at its other end with a handle member, the applicator element being housed in the receptacle when the receptacle is closed and being withdrawn therefrom in contact with an elastically deformable wiper member, wherein said wiper member is spaced from the bottom of said receptacle, the substance is freely contained in a space between said bottom and said wiper member, wherein said wiper member is constituted at least in part by a block of foam comprising at least 5% of open cells, wherein said block of foam is substantially closed at rest and opens when the applicator element passes therethrough, and a removable closure capsule that is replaced in use of the device by the applicator, said wiper member, in a removed position of the closure capsule, being fixedly mounted on the receptacle.

37. A device for packaging and applying a substance, in particular a cosmetic, the device comprising a receptacle that is open at one end and has a bottom, said receptacle being suitable for containing said substance to be applied, and an applicator comprising a stalk provided at one end with an applicator element and at its other end with a handle member, said applicator closing said receptacle, the applicator element being housed in the receptacle when the receptacle is closed and being withdrawn therefrom in contact with an elastically deformable wiper member, wherein said wiper member is spaced from the bottom of said receptacle, the substance is freely contained in a space between said bottom and said wiper member, wherein said wiper member is constituted at least in part by a block of foam, wherein said block of foam is substantially closed at rest and opens when the applicator element passes therethrough, and a removable closure capsule that is replaced in use of the device by the applicator, said wiper member, in a removed position of the closure capsule, being fixedly mounted on the receptacle.

* * * * *

UNITED STATES PATENT AND TRADEMARK OFFICE

CERTIFICATE OF CORRECTION

PATENT NO. : 6,305,861 B1
DATED : October 23, 2001
INVENTOR(S) : Jean-Louis Gueret It is certified that error appears in the above-identified patent and that said Letters Patent is hereby corrected as shown below:

Title page,
Item [56], immediately after 3,132,653 insert:
-- 3,146,806 9/1964 Ginsburg --.

Second column, after 0 405 103 insert:
-- 2,285,101 4/1976 France
82/02326 7/1982 WIPO --.

Signed and Sealed this

Twelfth Day of March, 2002

*Attest:*

*Attesting Officer*

JAMES E. ROGAN
*Director of the United States Patent and Trademark Office*